United States Patent [19]

Gromer et al.

[11] 4,219,436

[45] Aug. 26, 1980

[54] HIGH DENSITY, HIGH ALKALINITY DISHWASHING DETERGENT TABLET

[75] Inventors: Jürgen W. K. Gromer, Esslingen-Zell; Hans J. Pracht, Osthofen, both of Fed. Rep. of Germany

[73] Assignee: The Procter & Gamble Company, Cincinnati, Ohio

[21] Appl. No.: 910,915

[22] Filed: May 30, 1978

[30] Foreign Application Priority Data

Jun. 1, 1977 [GB] United Kingdom ..... 23132/77

[51] Int. Cl.[2] ..... C11D 7/36; C11D 17/00; C11D 7/14; C11D 7/16

[52] U.S. Cl. ..... 252/135; 252/174; 252/174.21; 252/DIG. 16

[58] Field of Search ..... 252/135, 156, 174, DIG. 16

[56] References Cited

U.S. PATENT DOCUMENTS

| | | | |
|---|---|---|---|
| 3,329,615 | 7/1967 | Cooper | 252/99 |
| 3,331,780 | 7/1967 | Krusius | 252/174 X |
| 3,344,076 | 9/1967 | Wilcox | 252/135 |
| 3,367,880 | 2/1968 | Keast et al. | 252/135 X |
| 3,417,024 | 12/1968 | Goldwasser | 252/135 |
| 3,450,494 | 6/1969 | Gaiser | 23/110 |
| 3,562,165 | 2/1971 | Altieri | 252/135 X |
| 3,674,700 | 7/1972 | Gaiser | 252/135 |
| 3,931,036 | 1/1976 | Pierce | 252/135 |

FOREIGN PATENT DOCUMENTS

| | | |
|---|---|---|
| 1271884 | 7/1968 | Fed. Rep. of Germany . |
| 850366 | 10/1960 | United Kingdom . |

*Primary Examiner*—Harris A. Pitlick

[57] ABSTRACT

A detergent tablet containing a builder salt has an alkalinity of at least equivalent to 3 g. of sodium hydroxide per 100 g. of the tablet composition and a density of at least 1.4 g./cc. The builder salt can be a mixture of a silicate salt and a phosphate salt, preferably with more silicate, for example sodium metasilicate, than phosphate, for example sodium tripolyphosphate. The tablets are preferably free of surfactant materials and are especially adapted for use in automatic dishwashing machines.

12 Claims, No Drawings

HIGH DENSITY, HIGH ALKALINITY DISHWASHING DETERGENT TABLET

This invention relates to detergent tablets and, in particular, to detergent tablets suitable for use in automatic dishwashing machines.

Although cleaning compositions in tablet or briquette form have frequently been proposed, these have not (with the exception of soap bars for personal washing) gained any substantial commercial success, despite the several advantages of products in a unit dispensing form. More particularly, none of the detergent tablets suggested heretofore can be advantageously employed in automatic dishwashing (ADW) machines for the reasons given below.

The cleaning of articles such as cooking ware, crockery and cutlery in an ADW machine is not an easy task. Food residues, especially after being baked-on or dried-on, can adhere very stubbornly to such articles and require substantial physical and/or chemical effort to remove. Products for use in automatic dishwashing machines therefore tend to be higly specialized for this purpose and, equally importantly, the ADW machine is uniquely designed to provide efficient cleaning of the soiled articles.

A well-nigh essential design feature of almost all dishwashing machines is the product dispenser. Because of the relative difficulty of cleaning soiled articles in an ADW machine, and especially because of the problems (e.g., overfoaming and redeposition) caused by the presence of any substantial amount of food soil in the wash solution, most ADW machines, especially in Europe, have a pre-wash rinse cycle during which most of the less strongly adherent food residues are removed. Normally, only after this rinsing step is the detergent product added to the machine and thereafter the main washing cycle commences. Clearly, it is desirable that a product dispenser is used, which automatically dispenses the detergent product into the machine after the pre-wash rinse cycle and before the wash cycle.

As far as the cleaning process itself is concerned, it is important that a sufficient amount of detergent product be dispensed into the machine. Removal of baked-on food is not easy, and normally a relatively large quantity of higly alkaline detergent is employed. Most conventional ADW detergent products are recommended to be added in an amount of about 40–50 g. per machine load.

Detergent tablets already known in the art do not meet the requirements indicated above. In particular, conventional tablets are compressed to a density of about 1 g/cc in order to achieve a practical compromise between strength and solubility; however, tablets of this density have insufficient weight per unit volume to dispense an adequate amount of detergent into an ADW machine. Furthermore, many of these known tablets are designed for laundry purposes and contain relatively large amounts of surfactant, usually anionic surfactant, materials and normally have a major proportion of condensed phosphate such as sodium tripolyphosphate. Such tablets cannot simply be made more dense because thereby they would become for all practical purposes far too insoluble.

Typical disclosures of such low-density detergent tablets are to be found in U.K. Patents Nos. 901,709; 989,683; 1,004,596; 1,013,686 and 1,031,831; in U.S. Pat. Nos. 2,875,155; 3,081,267; 3,245,122; 3,318,817; and 3,329,615; in German Patents Nos. 1,191,509 and 1,277,496; and in French Patent Nos. 1,420,795 and 1,596,316.

Disclosures of tablets alleged to be particularly suitable for dishwashing machines are mentioned in U.S. Pat. Nos. 3,450,494 and 3,674,700, but these tablets have relatively low bulk density and it is clear that they would give inadequate cleaning performance if made to a size suitable for automatic dispensing into a dishwashing machine.

It is an object of the present invention to provide detergent tablets that have a relatively high density.

It is a further object of the present invention to provide detergent tablets that provide effective cleaning performance and are adapted for automatic dispensing into an ADW machine.

According to the present invention, there is provided a detergent tablet having a density of at least 1.4 g./cc. and an alkalinity equivalent to at least 3 g. of sodium hydroxide per 100 g. of the tablet composition and comprising a builder salt.

In the context of the present invention, the term "detergent" does not necessarily imply the presence of a surfactant material. Tablets which exert their cleaning power solely by the presence of inorganic salts (such as phosphate and silicate) are encompassed within the present invention.

In preferred embodiments of the invention, the alkalinity of the tablet is equivalent to at least 10 g. of NaOH per 100 g., more preferably at least 25 g./100 g. Also in preferred executions, the alkalinity is derived mainly from the presence of the builder salt, an especially useful builder salt for this purpose being a water-soluble silicate salt. In a highly preferred tablet, the builder salt makes up at least 55% of the composition and comprises a mixture of a water-soluble silicate salt and a water-soluble phosphate salt, with a silicate:phosphate ratio of at least 1.

In still more preferred embodiments of the invention, more than 80% of the composition is formed by the silicate/phosphate mixture and the silicate:phosphate ratio is preferably from 2:1 to 4:1. It is also preferred that the density is at least 1.5, more preferably from 1.5 to 1.8 g./cc.

Tablets of the present invention are preferably completely free of surfactant materials and such surfactant-free tablets have the advantage of being particularly easily dissolved. However, up to 10% of a surfactant, normally a nonionic surfactant can be included if desired.

Tablets of the present invention have, as an essential physical property, an alkalinity equivalent to at least 3 g. of NaOH per 100 g. of the composition. An alkalinity equivalent to 3 g. of NaOH per 100 g. means that when tablets weighing 100 g. are dissolved in a certain amount of water, the same amount of N.hydrochloric acid is required to reduce the solution pH to pH 9.0 as if 3 g. of sodium hydroxide had been dissolved in the same amount of water. This alkalinity can be provided in any way, but at least part of the alkalinity is normally provided by one or more alkaline builder salts, preferably water-soluble builder salts. It is not however excluded that a neutral builder salt is employed together with, for example, free sodium hydroxide to provide the alkalinity. The term "builder salt" is intended to mean all materials which tend to remove calcium ion from solution, either by ion exchange, complexation, sequestration or precipitation.

Preferred above all other builder salts for the purpose of providing alkalinity are water-soluble silicate salts.

Examples of suitable silicates are those having the general formula $nSiO_2.M_2O$ where n is from 0.5 to 4.0 and M is a cation imparting water-solubility to the salt, preferably an alkali metal such as sodium or potassium. Such silicates can contain up to 50% by weight of water in the form of water by hydration. Preferred materials are sodium metasilicate and sodium sesquisilicate. Sodium orthosilicate may be used where very high alkalinity is desired. Sodium metasilicate is very highly preferred. In preferred compositions, the silicate salt (inclusive of any water of hydration) makes up from 50% to 90% of the tablet, preferably from 60% to 80%.

Another preferred builder salt, usually employed in combination with the silicate salt (although possibly employed as the sole builder salt), is a water-soluble phosphate. Any water-soluble phosphate salt can be employed in the present invention, for example, sodium orthophosphate, pyrophosphate, tripolyphosphate or more condensed phosphates such as hexametaphosphate. Condensed phosphates are preferred, especially sodium tripolyphosphate. The phosphate salt can be in at least partially hydrated form, particular examples being pentasodium tripolyphosphate hexahydrate and tetrasodium pyrophosphate decahydrate.

In preferred compositions, the phosphate salt (inclusive of any hydrated water) makes up from 10% to 40%. preferably from 20% to 30% of the tablet. It is particularly preferred that the composition comprises at least 70%, preferably at least 80%, of a mixture of a silicate and phosphate salt in a ratio of from 2:1 to 4:1. Such compositions have particularly good strength-/solubility characteristics especially, as explained later, when such tablets are free of surfactant.

Useful compositions according to the invention can be prepared simply by mixing the phosphate salt and the silicate salt together, without any other additives and compressing these into a tablet having a density of at least 1.4 g./cc. As already explained, it is important in the context of this invention that a relatively high density is achieved. Preferably, the density is from 1.5 to 1.8 g./cc. It has been found that tablets having a higher proportion of silicate than phosphate are particularly useful as these can be compressed to this degree while still having a surprisingly high speed of dissolving.

Other useful inorganic alkaline builder salts, which can be employed alone, or preferably in admixture with the silicate and phosphate salts include water-soluble carbonates, bicarbonates and borates.

Water-soluble organic builder components may also be employed. Examples of suitable organic detergency builder salts are: (1) water-soluble amino polyacetates, e.g., sodium and potassium ethylene-diamine tetra-acetates, nitrilotriacetates, and N-(2hydroxyethyl) nitrilodiacetates; (2) water-soluble salts of phytic acid, e.g., sodium and potassium phytates- and (3) water-soluble polyphosphonates, including alkali metal salts of ethane-1-hydroxy-1,1-diphosphonic acid; methylenediphosphonic acid, ethylene diamine tetramethyl phosphonic acid and the like.

Additional organic builder salts useful herein include the polycarboxylate materials described in U.S. Pat. No. 2,264,103, including the water-soluble alkali metal salts of mellitic acid. The water-soluble slats of polycarboxylate polymers and copolymers such as are described in U.S. Pat. No. 3,308,067, incorporated herein by reference, are also suitable herein.

It is to be understood that while the alkali metal salts of the foregoing inorganic and organic polyvalent anionic builder salts are preferred for use herein from an economic standpoint, the ammonium, alkanolammonium (e.g., triethanolammonium, diethanolammonium and monoethanolammonium) an other water-soluble salts of any of the foregoing builder anions can also be used.

A further class of builder salts useful herein is the water-soluble silicate type which functions by cation exchange to remove polyvalent mineral hardness and heavy metal ions from solution. A preferred builder of this type has the formulation $Na_z(AlO_2)_z(SiO_2)_y.xH_2O$ wherein z and y are integers of at least 6, the molar ratio of z to y is in the range from 1.0 to about 0.5 and x is an integer of from about 15 to about 264. Compositions incorporating builder salts of this type form the subject of British Patent Specification No. 1,429,143 published Mar. 24, 1976, German Offenlegungsschrift No. 2,433,485 published Feb. 6, 1975, and Offenlegungsschrift No. 2,525,778 published Jan. 2, 1976, the disclosures of which are incorporated herein by reference.

Although surfactant-free tablets are highly preferred and have the advantage of dissolving especially quickly, it is sometimes desirable, in order to improve end-result performance, to include a surfactant, preferably a low-sudsing nonionic surfactant. Tablets containing high levels (more than 10%) of anionic surfactant, should be avoided in the practice of the present invention because such tablets cannot be formed at an appropriate density while still retaining an acceptable dissolving speed.

Detergent tablets according to the present invention can therefore contain up to 10%, preferably less than 5%, and more preferably 0.1% to 2% of a nonionic surfactant and, normally, this is the sole surfactant in the composition.

Nonionic surfactants which are advantageously employed in the composition of this invention include, but are not limited to, the following polyoxyalkylene nonionic detergents: $C_8$–$C_{22}$ normal fatty alcohol-ethylene oxide condensates, i.e., condensation products of one mole of a fatty alcohol containing from 8 to 22 carbon atoms with from 2 to 20 moles of ethylene oxide, polyoxypropylene-polyoxyethylene condensates having the formula $HO(C_2H_4O)_x(C_3H_6O)_y(C_2H_4O)_{x1},H$ where y equals at least 15 and $(C_2H_4O)_{x+x1}$, equals 20–90% of the total weight of the compound; alkyl polyoxypropylenepolyoxyethylene condensates having the formula $RO—(C_3H_6O)_x(C_2H_4O)_yH$ where R is a $C_1$–$C_{15}$ alkyl group and x and y each represent an integer of from 2 to 98; polyoxyalkylene glycols having a plurality of alternating hydrophobic and hydrophilic polyoxyalkylene chains, the hydrophilic chains consisting of linked oxyethylene radicals and the hydrophobic chains consisting of linked oxypropylene radicals, said product having three hydrophobic chains, linked by two hydrophilic chains to the central hydrophobic chain constituting 30% to 34% by weight of the product, the terminal hydrophobic chains together constituting 31% to 39% by weight of the product, the linking hydrophilic chains together constituting 31% to 35% by weight of the product, the intrinsic viscosity of the product being from 0.06 to 0.09 and the molecular weight being from about 3,000 to 5,000 (all as described in U.S. Pat. No. 3,048,548); butylene oxide capped alcohol ethoxylates having the formula $R(OC_2H_4)_y(OC_4H_9)_x$ OH where R is a $C_8$–$C_{18}$ alkyl group and y is an integer from about 3.5 to 10 and x is an integer from about 0.5 to 1.5; benzyl ethers of polyoxyethylene condensates of alkyl phenols having the formula

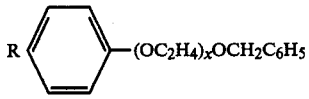

where R is a $C_6$–$C_{20}$ alkyl group and x is an integer of from 5 to 40; and alkyl phenoxy polyoxyethylene ethanols having the formula

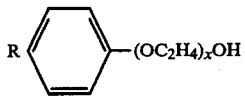

where R is a $C_8$–$C_{20}$ alkyl group and x is an integer of from 3 to 20. Also useful in the present invention are the polyethylene glycols, for example, those of molecular weight from 1,000 to 10,000, especially about 6,000, and these materials are to be considered as surfactant materials in the context of the present invention. Other nonionic detergents are suitable for use in the herein disclosed dishwashing compositions and it is not intended to exclude any detergent possessing the desired attributes.

Preferred nonionic surfactants are the condensates of from 2 to 15 moles of ethylene oxide with one mole of a $C_8$–$C_{20}$ aliphatic alcohol. Particularly preferred surfactants are those based on ethylene oxide condensates with primary aliphatic alcohols made by the "oxo" process. These alcohols are predominantly straight-chain aliphatic alcohols with up to about 25% of short-chain branching at the α-position. A suitable range of alcohol ethoxylates is made by the Shell Chemical Company and is sold under the trade name "DOBANOL". A particularly preferred material of this type is DOBANOL 45-4 which is the reaction product of 4 moles of ethylene oxide with 1 mole of a $C_{14}$–$C_{15}$ oxo-alcohol. Another preferred commercially available range of surfactants is based on the ethoxylates of relatively highly branched alcohols, containing up to 60% of $C_1$–$C_6$ branching at the 2-position. These alcohols are sold under the trade name "LIAL" by Liquichimica Italiana. A preferred material is LIAL 125-4, the condensation product of 4 moles of ethylene oxide with a $C_{12}$–$C_{15}$ alcohol. Another useful range of ethoxylated alcohols is the "TERGITOL" range, these consisting of ethoxylates of secondary alcohols. A preferred material is TERGITOL 15-S-3.

If a nonionic surfactant is included, it is preferred that the surfactant is located in the tablet in discrete areas. Alternatively expressed, it is important that the surfactant is not distributed equally over all the particles of the particulate composition which, normally, is compressed to form the tablet.

This can be achieved in various ways, depending on whether the surfactant is a solid or a liquid. A solid surfactant is defined as having a melting point above 20° C., a liquid surfactant having a melting point of 20° C. or less. Preferred solid surfactants have a melting point higher than 25° C.

Where the surfactant to be employed is a solid surfactant, the surfactant is preferably prepared in particulate form. This can be done in any of numerous ways. Among the simplest and most convenient is to cut the surfactant in a type of macerator or mixer with cutting blades, so that it is cut into small particles. Alternatively, a surfactant melt can be spray-cooled to give surfactant particles. The surfactant in particulate form is then mixed with the other particles of, for example, sodium metasilicate and sodium tripolyphosphate, the mixture being then compressed together. In this way, the surfactant is located in discrete areas which are distributed homogeneously throughout the tablet.

Solid surfactants, within the meaning of the present invention, can also comprise a mixture of surfactant and surfactant-like materials which mixture is solid within the above definition. Thus, mixtures of solid and liquid surfactants can, when co-melted, form a solid mixture. An example is a 50/50 mixture of polyethylene glycol 6000 and Dobanol 45-E-4 (an average tetra-ethoxylate of a $C_{14}$–$C_{15}$ alcohol).

The preferred surfactant materials are, however, liquid in character and with these materials it is desirable to spray the liquid surfactant onto only a proportion of the particles making up the solid composition to be compressed. In this way, the surfactant is essentially absorbed into only some of the particles making up the tablet and is thereby located in discrete areas. For example, if a tablet comprises about 70% sodium metasilicate and about 30% sodium tripolyphosphate, the surfactant could be sprayed onto the phosphate or onto the silicate alone or, even more preferably, onto only a portion of the phosphate or silicate. Nonionic surfactant loadings of up to about 15% (by weight of the particle) are possible with sodium metasilicate and up to about 10% with sodium tripolyphosphate.

If desired, the surfactant can be absorbed onto a highly porous carrier particle, for example starch, and this carrier particle would then be mixed in the normal way with the other ingredients. Other useful builder salts, for example sodium carbonate, can be effective carriers.

In general, when this approach is adopted, the surfactant is incorporated into from 5% to 30%, preferably from 10% to 20% of the particles making up the dry mixture to be compressed.

Another preferred method of incorporating surfactant is first to form a surfactant-free tablet and then coat the tablet with a surfactant-containing material in molten form. This method of incorporation has the advantage that the surfactant is completely isolated from the bulk of the tablet and can therefore not affect its hardness and strength. When this method is used, a preferred surfactant is a polyoxypropylene/polyoxyethylene condensate, for example Pluriol 10,800 (marketed by BASF).

Another ingredient that is preferably included in such a surfactant-containing coating is a suds suppressor, especially a silicone suds suppressor as described hereinafter.

Occasionally, such coated tablets tend to become somewhat sticky, especially when handled. To minimize this, a small quantity of an absorbent solid can be included in the molten coating material to impart a drier feel to the solid coating. A suitable material is a powdered aluminosilicate, for example the material sold by Sifrance under the trade name DG-12.

Detergent tablets of the present invention also preferably include a bleach component, preferably a chlorine bleach. This component is included in the composition at a level sufficient to give the composition an available chlorine content of from 0.2% to 10%, preferably 0.5% to 5%. As used herein, the term "available chlorine" indicates the amount of chlorine in the composition which is equivalent to elemental chlorine in terms of oxidizing power. "Active chlorine" is often used instead of "available chlorine". The same type of chlorine is designated by the two terms, but when expressed quantitatively "active chlorine" indicates the chlorine actually present. The numerical value for available chlorine content is twice that for active chlorine. Available chlorine contents below 0.2% fail to give proper cleaning performance, while amounts in excess of 10% do not result in any added cleaning ability. Any of many known chlorine bleaches can be used in the present detergent composition. Examples of such bleach compounds are: chlorinated trisodium phosphate, dichloroisocyanuric acid, salts of chlorine substituted isocyanuric acid, 1,3-dichloro-5,5-dimethylhydantoin, N,N'-dichlorobenzoylene urea, paratoluene sulfodichloroamide, trichloromelamine, N-chloroammeline, N-chlorosuccinimide, N,N'-dichloroazodicarbonamide, N-chloroacetyl urea N,N'-dichlorobiuret, chlorinated dicyandiamide, sodium hypochlorite, calcium hypochlorite, and lithium hypochloride. The preferred bleach is an alkali-metal salt of dichloroisocyanuric acid, e.g., potassium or sodium dichloroisocyanurate especially sodium dichloroisocyanurate dihydrate.

Compositions of the invention can also advantageously include preferably a surface-protecting agent. Sodium aluminate is one useful material, preferably employed in an amount from 0.03% to 4%, especially 0.04% to 1%. Another useful agent is a bismuth-containing salt, especially from 0.05% to 4% of bismuth citrate, as described in our co-pending British Patent Application No. 44865/76 (P & G Case CM-20), the disclosure of which is incorporated herein by reference.

Certain of the preferred surfactants of the present invention tend to over-suds in use and therefore preferred compositions include a suds suppressing agent.

Suds suppressing agents are preferably used in an amount of from 0.001% to about 6%, preferably 0.05% to 3%. The suds suppressing (regulating) agents known to be suitable as suds suppressing agents in the detergent context can be used in the compositions herein.

Preferred suds suppressing agents are silicone materials which can be described as a siloxane having the formula

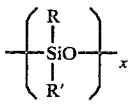

wherein x is from about 20 to about 2,000, and R and R' are each alkyl or aryl groups, especially methyl, ethyl, propyl, butyl and phenyl. The polydimethyl siloxanes (R and R' are methyl) having a molecular weight within the range of from about 200 to about 200,000 and higher, are all useful as suds controlling agents. Suitable polydimethyl siloxanes are commercially available from Dow Corning Corporation. The silicone suds suppressing agent is advantageously added in emulsified form and suitable emulsions are commercially available from Dow Corning Corporation, sold under the trade names Other useful suds suppressing agents include alkyl phosphate esters such as monostearyl phosphate and microcrystalline waxes having a melting point of from 65° C. to 100° C. and a molecular weight of from 400 to 1,000.

Neutral fillers such as sodium sulfate and sodium chloride can be present and various other components can be included for various purposes. Examples of such additional components are enzymes, especially proteases and amylases, (which are useful in the absence of chlorine bleach), tarnish inhibitors such as benzotriazole, bactericidal agents, soil-suspending agents, dyes and perfumes.

Tablets of the present invention are prepared simply by mixing the solid ingredients together and compressing the mixture in a conventional tablet press as used, for example, in the pharmaceutical industry. Any liquid ingredients, for example the surfactant or suds suppressor, can be incorporated in a conventional manner into the solid particulate ingredients. Preferably, the principal ingredients, silicate and phosphate, are used in granular form. Employing a granular form of silicate and phosphate leads to a more readily soluble tablet. The bulk density of the solid, particulate mixture should preferably be from about 0.8 to 1.1 g./cc.

In a highly preferred embodiment of the invention, a high density granular sodium tripolyphosphate is used. This material can be prepared by agglomerating anhydrous sodium tripolyphosphate in, for example, a Schugi granulator (as described in U.K. Patent No. 1,319,883) with sufficient water to give a sodium tripolyphosphate with about 14% water of hydration. This material has a bulk density of about 0.8 g./cc. High density granular sodium metasilicate is also preferred. Commercially available granular materials are available at a bulk density of 0.76 g./cc and 16% water of crystallization) and of 1.3 g./cc. (1% water of hydration).

In order to achieve the necessary density for tablets of the present invention, very high pressure must be employed, far higher than are conventional in detergent tablet making. For example, U.S. Pat. No. 3,674,700 indicates that suitable pressures for preparing detergent tablets range from 0.7 to 5.6 kg/sq.cm., resulting in tablets having a density of from 0.3 to 1.28 g./cc. By contrast with this, the process of the present invention utilizes pressures of from 200 to 3,000 kg/sq.cm., preferably 300–1,500 kg./sq.cm., giving tablets having a density of at least 1.4 g./cc. and normally from 1.5 to 1.8 g./cc. A preferred pressure for the tablet press is from about 300 to 1,200 kg/sq.cm.

Tablets produced according to the above process have the required density and, because of the high pressure used in their manufacture, have the additional advantage of being very hard so that they can be handled without fear of breakage. A further advantage of tablets of this hardness is that they can withstand the biting pressure exerted, for example, by a child who, inadvertently, is permitted to handle the tablet.

Pressing tablets at the above pressures may cause some difficulties with regard to release from the mold. These can be overcome, for example, by incorporating of any of the well-known mold release agents such as calcium stearate, talcum powder, siliconized talcum, stearic acid or paraffins. Incorporation of a surfactant can also be helpful as can the simple expedient of arranging for water-lubrication of the mold. Commercially available tableting machines can have automatic mold lubrication.

Other conventional tablet-making aids can be included. These include glidants and lubricants such as GLEITOL (Registered Trade Mark), insoluble stearate salts, fatty acids, fatty alcohols, starch, polyethylene glycol (m.wt. 6000) and AEROSIL (Registered Trade Mark).

Disintegrants can usefully be included to obtain higher dissolving speeds. Examples of such materials are formaldehyde-casein (sold under the trade name ESMA SPRENG), colloidal silica, starch alginic acid and salts thereof, Veegum clays, sugars, gelatin and zeolites.

The tablets can be made in any desired shape, for example cylindrical or cubical, but a preferred shape is an equilateral triangular prism. A tablet of this shape and having a size of about 3.3 cm (triangle side) by 1.7 cm (thickness), with a density of from about 1.5 to 1.8 g./cc, weights about 18–25 g., so that two of these tablets provide sufficient material for one work load. It has been established that two tablets of this shape and size can be dispensed without difficulty from most household dishwashing machines.

Tablets of about the above shape and dimension have the additional advantage that not only can they be accommodated in almost all European ADW machine dispensers but also they cannot readily, if at all, be swallowed by young children who may, inadvertently, be in contact with them.

In a preferred embodiment of the invention, the tablet prepared as above is provided with an outer coating. This coating enhances the external appearance and feel of the tablet and, additionally, minimizes the possibility of tablet abrasion, and reduces the risk that a person handling the tablet comes into direct contact with the relatively alkaline core. A wide range of water-soluble coating materials is possible, the preferred materials including silicate solution (sodium silicate with $SiO_2$:-$Na_2O$ ratio of 2.0:3.2); gelatin; fatty acids, such as tallow fatty acid; fatty alcohols; and polyethylene glycols having molecular weight of from 5,000 to 20,000. A particularly preferred material is polyethylene glycol of molecular weight 10,000. Other useful coating materials are cellulose acetate phthalate (sold under the trade name EUDRAGIT S), polyacrylates (e.g., ROHAGIT sold by Rohm & Haas), SYNTHOPLEX (Registered Trade Mark), zein and shellac.

A wide range of organic film-forming polymers can also be used, for examples those described in British Patents Nos. 989,683, 1,013,686; and 1,031,831, the disclosures of which are incorporated herein by reference.

The coating can be applied using any of the well-known procedures for tablet coating. These include spraying-on, dipping, passing through a falling curtain of coating material, etc.

If desired, coloring material can be incorporated into the coating to give the tablet an aesthetically pleasing appearance. Other conventional additives such as perfumes, bactericides, etc. can be added.

The invention is illustrated by the following examples.

EXAMPLE 1

Granular sodium metasilicate (34.0 g.), granular sodium tripolyphosphate (12.0 g.), sodium aluminate (0.08 g.), bismuth citrate (0.04 g.) and sodium dichloroisocyanurate (1.1 g.) were blended together in a mixing vessel to form a homogeneous particulate mixture. About 21 g. of this mixture were introduced into a mold of triangular shape with equilateral triangle sides of 3.3 cm and were compressed in this mold under a pressure of 550 kg./sq.cm to give a tablet of about 1.7 cm. thickness and a density of about 1.55 g./cc.

Two of the tablets prepared as above can be dispensed into a ADW machine and provide outstanding cleaning performance when compared with commercially available ADW products.

EXAMPLE 2

A tablet prepared as in Example 1 was coated by dipping the tablet into a 30% solution in ethanol of polyethylene glycol 10000 containing 10% of monostearyl acid phosphate. The tablet, after drying, became uniformly coated with 0.3 g. of the coating mixture.

The coating reduced any tendency for the tablet to abrade and gave a tablet which was pleasant to handle. The coating has no influence on the cleaning performance of the tablet. Alternatively, a molten mixture of polyethylene glycol 10000 containing monostearyl acid phosphate can be sprayed onto the tablet to form the coating.

EXAMPLE 3

A tablet was prepared according to the manner described in Example 1 but was compressed under a pressure of 300 kg./sq.cm. The resultant tablet had a density of 1.5 g./cc., gave excellent cleaning performance and dissolved rapidly when used in an ADW machine.

EXAMPLE 4

Granular sodium metasilicate (65.0 g.), granular sodium tripolyphosphate (28.5 g), sodium aluminate (1.2 g.), and sodium dichloroisocyanurate dihydrate (1.5 g.) were mixed together and polyethylene glycol (0.15 g.) having a molecular weight of 1,500 (prepared in particulate form by the action of a blending machine) was mixed into the granular mix. About 23 g. of this mixture were introduced into a mould and were compressed under a pressure of 350 kg./sq.cm. to give a tablet of density about 1.8 g./cc.

Two tablets prepared as above, when added to an ADW machine, dissolved rapidly and gave excellent cleaning performance when compared with commercially available ADW products.

Similar results were obtained when the above Example was repeated using instead of polyethylene glycol an ethoxylated derivative (25 moles of ethylene oxide) of tallow alcohol.

EXAMPLE 5

Dobanol 45-E-7, a hepta-ethoxylate of a $C_{14}$–$C_{15}$ alcohol, (1.5 g.) was sprayed onto granular sodium metasilicate (16.0 g.). The nonionic-carrying metasilicate was intimately mixed with sodium tripolyphosphate (28.5 g.), granular sodium metasilicate (49.0 g.) and sodium dichloroisocyanurate (1.1 g) and 25 g. of the particulate mixture was compressed under a pressure of 600 kg./sq.cm. to give tablets (23 g.) of density 1.9 g./cc.

The tablet dissolved rapidly in the wash cycle of an ADW machine and gave excellent cleaning performance.

EXAMPLE 6

Dobanol 45-E-4, a tetra-ethoxylate of a $C_{14}$–$C_{15}$ alcohol, (1.0 g.) was sprayed onto granular sodium tripolyphosphate (20.0 g.). This was then mixed together with more sodium tripolyphosphate (20.0 g.), sodium metasilicate (60.0 g.), sodium dichloroisocyanurate (1.5 g.)

and monostearyl acid phosphate (0.5 g.). The particulate mixture was compressed under a pressure of 1200 kg./sq.cm. to give tablets of density 2.0 g./cc.

The tablets exemplified in the Tables below can all be prepared in the manner described in Example 1, preferably in a mold having automatic water-lubrication. The tablets of the following examples are normally compressed to give a tablet density of between 1.5 and 1.8. Where surfactant and other liquid ingredients are included, these can be sprayed onto all or, preferably, part of the particulate mixture before compressing.

In the Tables which follow, the ingredients referred to as A, B, C, . . . etc. have the following meaning:

| | |
|---|---|
| A | Sodium metasilicate |
| B | Sodium sesquisilicate |
| C | Sodium hydroxide |
| D | Sodium tripolyphosphate (granular, 14% hydration) |
| E | Sodium carbonate |
| F | Sodium ethylene diamine tetra-acetate |
| G | $Na_{12}(AlO_2,SiO_2)_{12} \cdot 27H_2O$ |
| H | Sodium nitrilotriacetate |
| I | Dobanol 45-E-7 |
| J | Dobanol 45-E-4 |
| K | Monstearyl acid phosphate |
| L | Sodium dichloroisocyanurate |
| M | Chlorinated trisodium orthophosphate |
| N | Sodium sulphate |
| O | Sodium aluminate |
| P | Bismuth citrate |
| Q | Starch |
| R | Silicone emulsion (Dow Corning DB-31) |
| S | Moisture/miscellaneous |

The following are further Examples of the invention.

| | EXAMPLES | | | | | | | |
|---|---|---|---|---|---|---|---|---|
| Ingredients | 7 % | 8 % | 9 % | 10 % | 11 % | 12 % | 13 % | 14 % |
| A | 95 | 70 | 40 | 35 | 60 | — | 40 | 40 |
| B | — | — | — | — | — | — | — | — |
| C | — | — | — | — | 20 | — | 20 | — |
| D | — | — | — | — | — | 60 | 30 | 40 |
| E | — | — | — | — | — | — | — | — |
| F | 3 | — | — | — | 10 | 2 | — | — |
| G | — | — | 50 | 30 | — | — | — | — |
| H | — | — | — | 30 | — | 20 | — | — |
| I | 1 | — | — | — | — | — | — | — |
| J | — | 1 | — | 0.5 | — | 0.5 | — | — |
| K | 0.5 | — | — | 0.3 | — | 0.2 | — | — |
| L | — | — | 4 | 2.5 | 5 | 2.0 | — | 2.0 |
| M | — | 25 | — | — | — | — | — | — |
| N | — | — | 4 | — | 3 | 14 | 8 | 16 |
| O | — | — | — | 0.8 | 1 | — | 0.2 | 0.2 |
| P | — | 0.8 | — | 0.3 | 0.5 | — | 0.1 | 0.1 |
| Q | — | — | 1 | — | — | — | — | — |
| R | — | 0.3 | — | — | 0.1 | — | 0.5 | — |
| S | | | | to 100 | | | | |

| | EXAMPLES | | | | | | | |
|---|---|---|---|---|---|---|---|---|
| Ingredients | 15 % | 16 % | 17 % | 18 % | 19 % | 20 % | 21 % | 22 % |
| A | 30 | — | 70 | — | — | 60 | — | 36 |
| B | — | — | — | 40 | 70 | — | 50 | — |
| C | — | 4 | — | — | — | — | — | — |
| D | 20 | 15 | 20 | 50 | 25 | — | 40 | 60 |
| E | 20 | 20 | — | — | — | 35 | — | — |
| F | 2 | — | — | — | 1 | — | — | — |
| G | — | — | — | — | — | — | — | — |
| H | — | — | — | — | — | — | — | — |
| I | — | 0.2 | — | — | — | — | — | — |
| J | — | — | — | 0.5 | 0.5 | — | — | — |
| K | — | 0.1 | — | 0.1 | 0.1 | — | — | — |

-continued

| | EXAMPLES | | | | | | | |
|---|---|---|---|---|---|---|---|---|
| Ingredients | 15 % | 16 % | 17 % | 18 % | 19 % | 20 % | 21 % | 22 % |
| L | — | — | — | — | — | 2.0 | 3.0 | 2.5 |
| M | 25 | 30 | 10 | — | — | — | — | — |
| N | — | 30 | — | 9 | — | — | 5 | — |
| O | — | — | — | — | — | — | — | — |
| P | — | — | — | — | — | 1.0 | — | — |
| Q | 1 | — | — | 0.5 | — | — | — | — |
| R | 0.2 | — | — | — | — | 0.1 | 1 | 0.5 |
| S | | | | to 100 | | | | |

| | EXAMPLES | |
|---|---|---|
| Ingredients | 23 % | 24 % |
| A | 32 | 65 |
| B | — | — |
| C | 10 | — |
| D | 50 | 30 |
| E | — | — |
| F | — | — |
| G | — | — |
| H | — | — |
| I | — | — |
| J | — | — |
| K | — | — |
| L | 4.0 | 2.0 |
| M | — | — |
| N | — | — |
| 0 | 2.0 | — |
| P | — | — |
| Q | — | — |
| R | — | — |
| S | to 100 | |

What is claimed is:

1. A rapidly dissolving detergent tablet for use in an automatic dishwasher, having a density of at least 1.4 g./cc. and an alkalinity equivalent to at least 3 g. of sodium hydroxide per 100 g. of the tablet composition, comprising a builder salt and from about 0.1 to about 2% of a surfactant.

2. The tablet of claim 1 wherein the density is from 1.5 to 1.8 g./cc.

3. A surfactant-free detergent tablet having a density of at least 1.4 g./cc. and comprising (a) from 50% to 90% of a water-soluble silicate salt and (b) from 10% to 40% of a water-soluble phosphate salt.

4. The tablet of claim 3 wherein the ratio of silicate salt to phosphate salt is from 2:1 to 4:1.

5. The tablet of claim 4 wherein the silicate salt is sodium metasilicate and the phosphate salt is sodium tripolyphosphate.

6. The tablet of claim 5 wherein the density is from 1.5 to 1.8 g./cc.

7. The tablet of claim 3 which has an outer coating comprising from about 0.1% to about 2% of a nonionic surfactant.

8. A composition according to claim 1, wherein said surfactant is a nonionic surfactant and is the sole surfactant in the detergent tablet.

9. A process for preparing a rapidly dissolving automatic dishwasher detergent tablet having a density of at least 1.4 g./cc., containing from about 0.1 to about 2% of a surfactant, wherein a particulate mixture of builder salts including a water-soluble silicate salt and a water-soluble phosphate is compressed at a pressure of from 200 to 3,000 kg./sq.cm.

10. The process of claim 9 wherein the mixture is compressed at a pressure of from 300 to 1200 kg./sq.cm.

11. The process of claim 9 wherein the silicate and phosphate salts are both in granular form.

12. A process according to claim 9, wherein said surfactant is a nonionic surfactant and is the sole surfactant in the detergent tablet.

* * * * *